United States Patent [19]

Seibert

[11] 4,209,140

[45] Jun. 24, 1980

[54] APPARATUS FOR WINDING OR UNWINDING OF A CORD-SHAPED MATERIAL

[76] Inventor: Gerhard Seibert, Putzendoplergasse 3, 1232 Vienna, Austria

[21] Appl. No.: 21,376

[22] Filed: Mar. 19, 1979

[30] Foreign Application Priority Data

Mar. 31, 1978 [DE] Fed. Rep. of Germany ..... 2813910

[51] Int. Cl.[2] ..... B21C 47/24; B65H 19/30

[52] U.S. Cl. ..... 242/79; 242/58.6; 414/911

[58] Field of Search ..... 242/79, 78.8, 58.6; 414/911

[56] References Cited

U.S. PATENT DOCUMENTS

| | | | |
|---|---|---|---|
| 2,962,241 | 11/1960 | Campbell | 242/79 |
| 3,321,147 | 5/1967 | Martin | 242/58.6 |
| 3,995,758 | 12/1976 | Kovaleski | 242/79 |
| 4,046,331 | 9/1977 | Decker | 242/58.6 |
| 4,088,277 | 5/1978 | Councell | 242/58.6 |

*Primary Examiner*—Edward J. McCarthy
*Attorney, Agent, or Firm*—Martin A. Farber

[57] ABSTRACT

An apparatus for winding or unwinding of a cord-shaped material, e.g., of electrical cables, steel cables, or ropes, on and off a spool. The apparatus has two downwardly pointing arms, the lower ends of which each carry a sleeve for receiving the spool. Since the exchange of particularly heavy weight spools previously was time consuming and physically very strenuous, whereby in addition a great danger of injury exists for service personnel, for the elimination of these disadvantages the invention provides that about a horizontal axis at least one of the sleeve arms is able to be swung up out to over the space assumed by a spool which has been set on the floor, and the apparatus is open on the side of the swingeable-up sleeve arm to an extent facilitating a relative movement of the spool and the apparatus.

10 Claims, 10 Drawing Figures

APPARATUS FOR WINDING OR UNWINDING OF A CORD-SHAPED MATERIAL

The invention relates to an apparatus for winding or unwinding of a cord-shaped material, e.g., of electrical cables, steel cables, or ropes, on and off a spool, with two sleeve arms which have on their lower ends respectively each a sleeve for receiving the spool.

Devices of this type are used particularly when the windable material, which is to be wound and unwound, respectively, on and off of spools of appropriate diameter, is of large diameter. Spools or drums of this order of magnitude may weigh several tons when fully wound. According to conventional practice today it is generally not possible to directly receive such drums, for example, with a fork-lift vehicle.

Empty spools on which the winding material is to be wound are brought in front of the winding machine by wheelbarrow, cart or crane and deposited on the floor. The spool is then rolled on the floor up to a position until the sleeves of the device can receive the spool. After the spool is fully wound, the full spool is again deposited on the floor, and the sleeves are releaseably disengaged from the flanges of the spool. The heavy spool must now be rolled out of the machine up to a point where it can be received or picked up by a transporting means. If the device is used to unwind a spool, correspondingly then the fully loaded spool must be rolled-in and the empty spool must be rolled out from the machine.

This rolling of the spool drums on the shop floor presents many hazardous moments for men and machine. Great forces must be applied to get a spool, weighing several tons under the circumstances, rolling and steered in the proper direction to its designated position. Correspondingly great forces are necessary to brake the spool to a stop.

A further serious disadvantage of these devices lies in the fact that the winding or unwinding process is interrupted for a relatively long time during a changing of the spools or drums. So as not to further increase this loss of time in changing the drums it is necessary to have, e.g., a crane or fork-lift, available on standby for a spool exchange, thus taking them away from some other work.

It is an object of this invention to provide a device for winding or unwinding a cord-shaped windable material which increases the safety of the winding area, is able to reduce the work forces which are required, and which reduces the time required for changing the spools or drums to a minimum.

It is another object of the present invention to aid in the solution of the above-mentioned object in the manner that about a horizontal axis or axle (9), at least one of the sleeve arms (10,11) is able to be swung up out to over the space assumed by a spool which has been set on the floor, and the apparatus is open at the side of the swingeable-up sleeve arm to an extent facilitating a relative movement of the spool and the apparatus.

By these measures new, less dangerous operating methods are made possible for bringing in, and respectively, removing the spools from the winding device. For example now after a fully wound spool is deposited on the floor and after releasing the sleeves and swinging up the sleeve arms, a fork-lift truck extends in the laterally open winding device and the spools are grabbed and are removed from the device. Thereafter an empty drum with a fork-lift truck can be inserted likewise from the side into the device, after which the sleeve arm or the sleeve arms, respectively, are again swung down and their sleeves are brought into engagement with the spool. Particularly with very large devices for heavy spools it is recommended to suspend the sleeves on a frame or support which can be moved on floor rails, framework rails or overhead or ceiling rails. In such a case after depositing a fully wound spool and swinging the sleeve arms up, the device moves away toward the side over the deposited spool, after which with a crane or any other conveying means then the wound spool is carried away and a new, empty spool can be led in.

The moveability of the device offers the great advantage that the exchange or replacement of the spool can be brought about timewise independent of the use of a transportation means. In an advantageous manner the device is moveable on its rails toward each side from out of the working position so far that a spool can be set down, and a spool which stands ready can be received. After the device has been moved back to its working position it can perform the next winding or unwinding operation while the previously set down spool can be taken away and a new spool can be moved in.

An embodiment of the invention can be provided in the manner that both sleeve arms (10,11) are able to be swung-up from out of a vertical working position by about 90 degrees. Preferably both sleeve arms (10,11) can be suspended on a horizontal carrier (9), which carrier is rotatably mounted on crossbeams (5) of a frame (1), which frame is moveable on floor rails, framework rails or overhead or ceilings rails.

This carrier can be driven directly by a motor or can be placed in rotation via corresponding lever or power members.

Another device is described in my allowed co-pending patent application Ser. No. 892,962, filed Apr. 3, 1978, hereby incorporated by reference as well as prior patented devices cited during prosecution.

With the above and other objects and advantages in view, the present invention will become more clearly understood in connection with the following detailed description of preferred embodiments, when considered with the accompanying drawings, of which:

Figure 4:
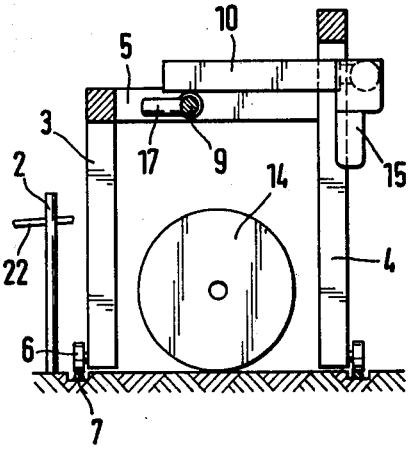
FIG. 4 is a section through the device according to the lines IV—IV in FIG. 3 with the sleeve arms swung-up.
Figure 5A:
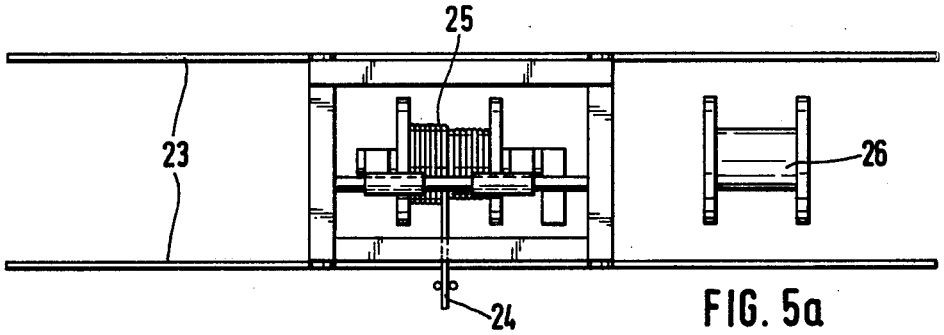
Figure 5B:
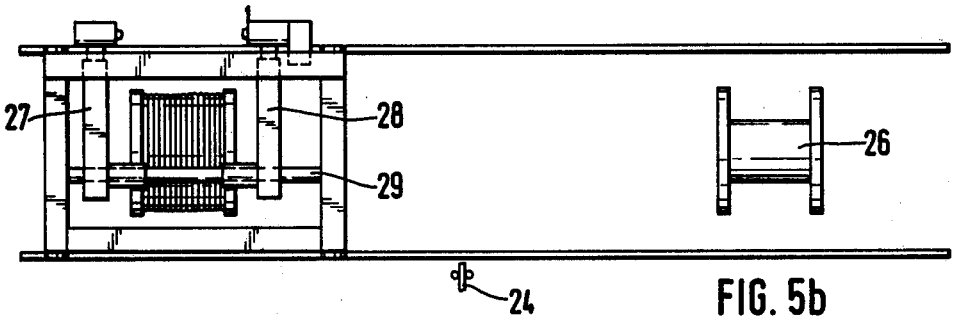
Figure 5C:
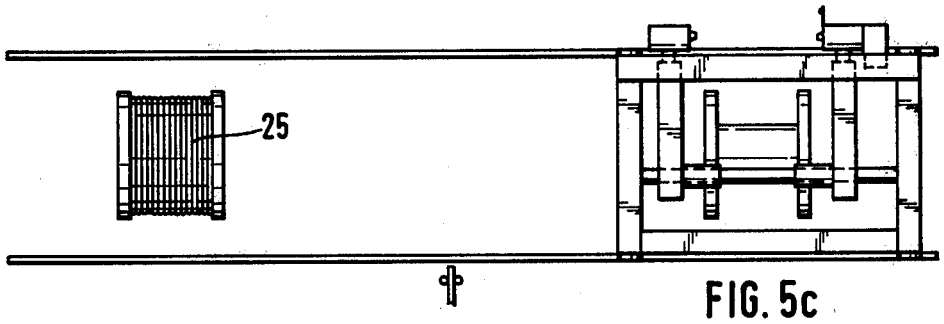
Figure 5D:
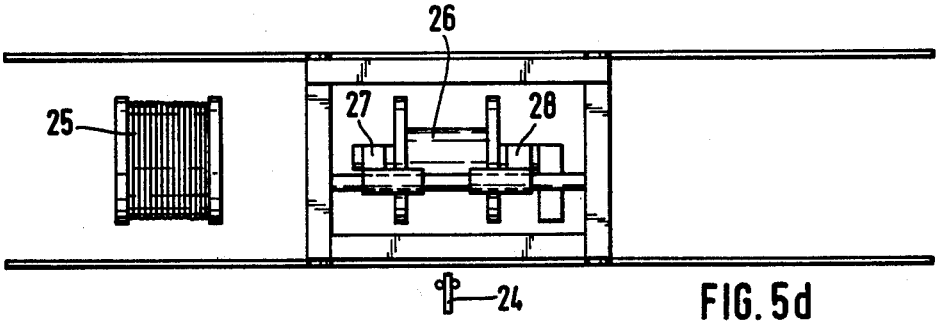
Figure 6A:
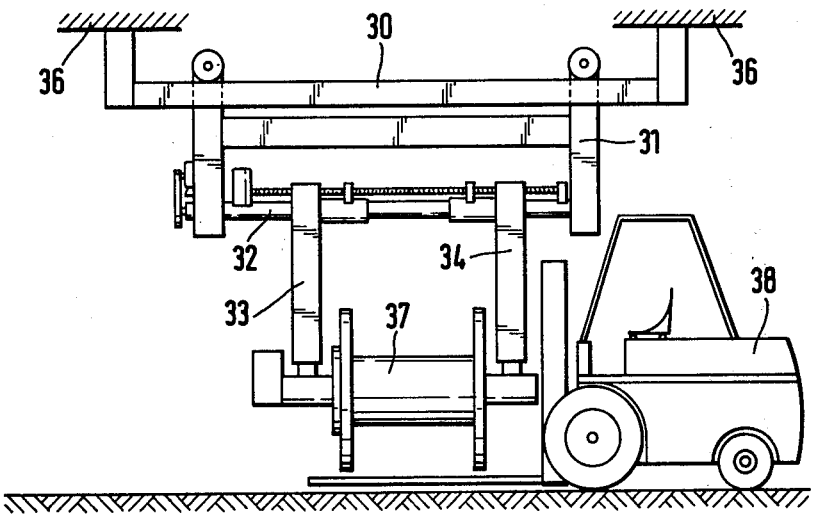
Figure 6B:
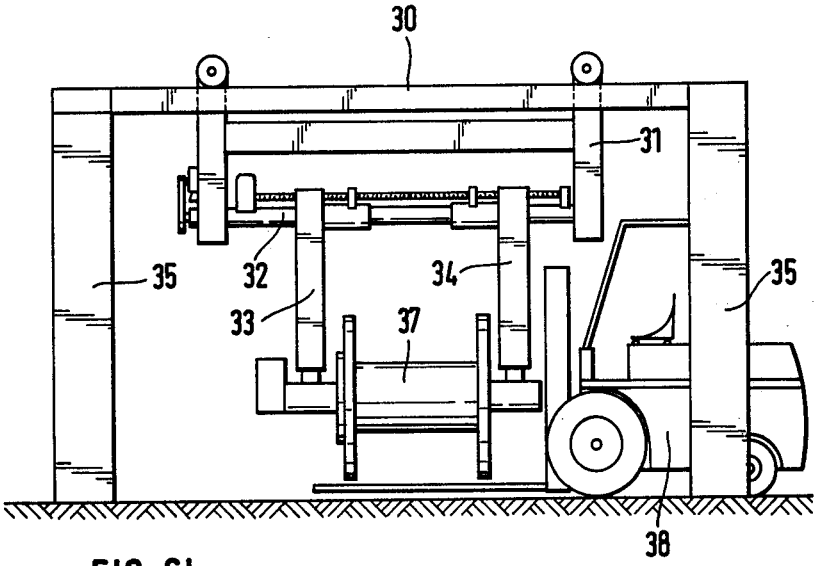

FIGS. 5*a*, 5*b*, 5*c* and 5*d* are schematic views of a working course with the device according to FIGS. 1 to 4; and FIGS. 6*a* and 6*b* are modified winding devices with a frame which can be moved on standing or suspended-rails, respectively.

Figure 1:
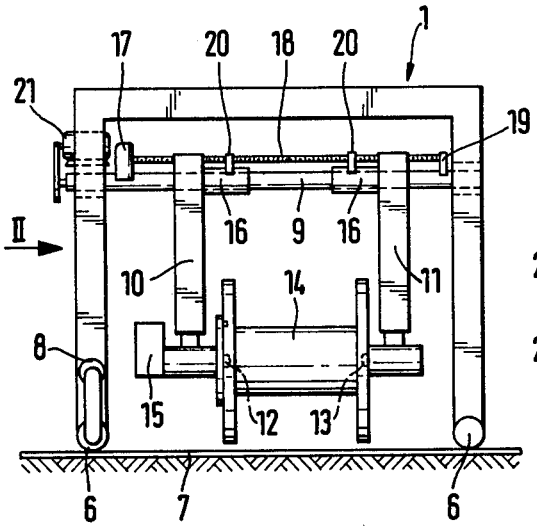
FIG. 1 is an elevational view of a winding device shown in its operation position with a framework which is moveable on floor rails, viewed in the direction of feeding of the cable.
Figure 2:
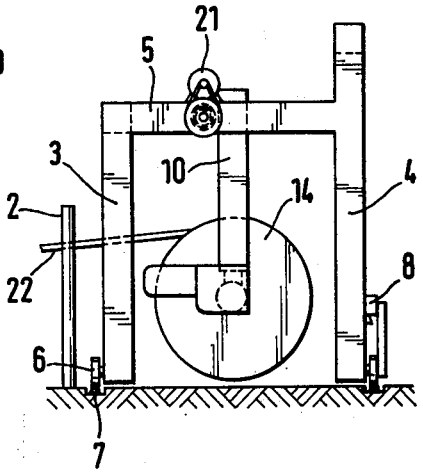
FIG. 2 is a side view of the device of FIG. 1 according to the arrow II.
Figure 3:
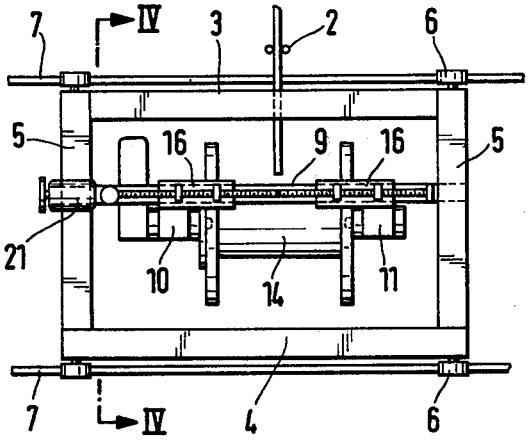
FIG. 3 is a plan view of the device according to FIG. 1.

FIG. 1 shows a device for winding or unwinding windable material which has a moveable framework 1. This framework 1 comprises a front frame 3 which faces the cable supply 2 and a rear frame 4, the vertical leg of the latter being longer than that of the front frame 3. The two frames 3,4 are rigidly connected with one another by means of crossbeams 5. Wheels 6 are mounted on the lower ends of the frames, which wheels run on rails 7 and are driven by a motor 8 which is mounted on the rear frame 4.

A carrier 9 is rotatably mounted on the crossbeams 5 approximately in the center between the frames 3,4. Longitudinally adjustable sleeve arms 10, 11 are mounted on the carrier by means of a driving means such as a spindle drive or a hydraulic drive (not shown). The sleeves or pintles 12,13 are located on the lower free ends of the sleeve arms 10,11. A drum or spool 14 is suspended on the sleeves 12, 13. A motor 15 for rotatably driving the spool 14 is mounted on the sleeve arm 10. If the device is equipped for unwinding of spools, the rotary drive motor 15 is replaced by a brake. In the area of their upper ends the sleeve arms 10,11 are rigidly connected with guide pieces 16 which are displaceable on the carrier 9, however non-rotatably mounted. In order to be able to adjust the mutual spacing of the sleeve arms 10,11 with respect to each other, a motor 17 is mounted on the carrier 9, which motor drives a spindle 18 having counter-running threaded sections. The end of the spindle 18 is guided in a bearing 19 which bearing is mounted on the carrier 9, while the guide pieces 16 stand in engagement with the spindle via a threaded member 20.

The carrier 9 can be turned by means of a motor 21 which is mounted on one of the crossbeams 5, whereby the sleeve arms 10,11 which are released or disengaged from the spool 14 swing upwardly away from the spool receiving space.

FIG. 4 in a side view showing the spool 14 which is set down on the floor, completely wound with cable 22, and the sleeve arms 10, 11 which are swung up on the device. In the embodiment example, in the region of their upper ends, the sleeve arms 10,11 are fastened laterally on the guide pieces 16. With centrality of the sleeve arms between the frames 3, 4 this leads to eccentricity of the carrier 9 on the crossbeams 6. Naturally it is also possible to connect the sleeve arms on their upper face-sided end surfaces with the guide pieces 16, so that the carrier can be mounted exactly centrally on the crossbeams 5 and the sleeve arms would lie in the side view in the swung-up condition congruent or aligned with the crossbeams 5. Since with the illustrated embodiment both narrow sides of the device which are formed like gates are open, either a fork-lift can move-in in the direction of one of the flanges of the spool and receive this, while the device is found in the working position, or after it has set its spool on the floor it can move away over the spool to the side, after which the spool can be carried away by means of a crane or a fork-lift truck. The latter manner of operation is explained as follows on the basis of FIG. 5.

During the spool replacement in order not to have to be assigned to a transportation means which stands ready, the device is set on rails 23, which are approximately three times the length of the device. In the working position the device stands approximately in the center on the rails (FIG. 5a) and winds the cable 24 which is fed from the front (normally with changing motion) on the drum 25. To the right next to the device between the free ends of the rails, an empty spool 26 is set down with its axle parallel to the rails. If the drum 25 is completely wound, the feeding of the cable 24 is interrupted and the device travels to the left by approximately the length of the device. After the full drum 25 has been set down on the floor between the rails by lowering the sleeve arms, the sleeve arms 27, 28 are moved apart from one another on the carrier 29. Consequently the carrier 29 is turned so that the sleeve arms are swung up to the rear side of the device until they assume an approximately horizontal position in the upper range of the device (FIG. 5*b*). With sleeve arms which are swung-up away from the spool receiving space, the device travels without the spool over to the right until the empty drum 26 in the plan view is located exactly between the still yet swung-up arms. Now by rotating the carrier 29 back, the sleeve arms are swung down into their vertical position. After the sleeves have been brought into the reception holes of the spool by moving the sleeve arms together, the spool is lifted and the device moves back into the working position (FIGS. 5*c* and 5*d*). While the spool 26 is being wound, the full spool 25 occasionally can be taken away by a transportation means and an empty spool can be placed ready for the next spool exchange. For this manner of operation it is of course necessary that both face sides between the longitudinal frames of the framework have an interior open width which is sufficient for traveling over the spool.

The rotating drive 21 of the carrier 9 must only be designed as strong as is necessary for overcoming the unloaded weight of the sleeve arms 10, 11. If the motor output for swinging of the sleeve arms is dimensioned so much that even a full spool can be lifted therewith, the drive means for the extension of the sleeve arms for the purpose of receiving and setting a spool down can be eliminated, since with downwardly swung sleeve arms the spool can be received or, respectively, set down, and with partially pivoted-up sleeve arms it can be completely wound or unwound.

FIG. 6a shows a winding device with a frame 31 which is moveable on upper rails 30. The rotatable carrier 32 with the sleeve arms 33, 34 is mounted on the frame or support 31. The two planar rails (only the front is to be seen) are suspended on a ceiling 36. The frame 31 is moveable here only to an extent corresponding to the remaining changing or shifting movement of the spool during the winding operation, so that the rails can be kept comparatively short. After placing the spool 37 down and swinging the sleeve arms 33, 34 up, a fork-lift truck 38 can here move directly into the device from the side and execute the drum replacement.

FIG. 6*b* shows a winding device, the rails 30 of which stand on high columns or supports 35. The rest of the construction of the winding device and its manner of operation correspond to the winding device illustrated in FIG. 6*a*.

While I have disclosed several embodiments of the invention it is to be understood that these embodiments are given by example only and not in a limiting sense.

I claim:

1. An apparatus for winding or unwinding of a cord-shaped material, e.g., of electrical cables, steel cables, or ropes, on and off a spool, comprising a frame having sides and defining a horizontal axis which is above a space for receiving a spool.

two sleeve arms hanging from said horizontal axis and having on their lower ends, respectively, each a sleeve means for receiving a spool, means for mounting at least one of said sleeve arms rotatable about said horizontal axis to a position higher than the space assumed by a spool which has been set on the floor, and said frame is open at the side of the rotatable said at least one of said sleeve arms to an extent facilitating a relative movement of the spool and the apparatus.

2. The apparatus as set forth in claim 1, wherein both said sleeve arms are mounted so at to swing up from out of a vertical working position by about 90 degrees, and said frame is open on both sides thereof.

3. The apparatus as set forth in claim 1 or 2, wherein said frame has crossbeams, a horizontal carrier constituting said mounting means and said horizontal axis, both said sleeve arms are suspended on said horizontal carrier, said horizontal carrier is rotatably mounted on said crossbeams of said frame, said frame has wheels and is moveably mounted on rails.

4. The apparatus as set forth in claim 3, wherein said rails are floor rails.

5. The apparatus as set forth in claim 3, wherein said rails are framework rails.

6. The apparatus as set forth in claim 3, wherein said rails are ceiling rails.

7. The apparatus as set forth in claim 3, wherein said sleeve arms are displaceably mounted relative to one another on said horizontal carrier but non-rotatably mounted relative to said horizontal carrier, the latter comprising an axle, a counter-threaded spindle means mounted on said horizontal carrier for longitudinally displacing said sleeve arms relative to each other along said axle.

8. The apparatus as set forth in claim 7, further comprising tubular guide pieces connected to said sleeve arms and and displaceably mounted on said axle and constituting means for displaceable mounting said sleeve arms on said horizontal carrier, threaded members connected to said guide pieces and operatively engaging said spindle means.

9. The apparatus as set forth in claim 8, wherein said horizontal carrier is mounted off-center on said crossbeams and said sleeve arms are located centrally in said frame in a vertical working position of the sleeve arms.

10. The apparatus as set forth in claim 3, wherein said sleeve arms are located centrally in said frame in a vertical working position of the sleeve arms.

* * * * *